US008403729B1

(12) United States Patent
Ellison

(10) Patent No.: US 8,403,729 B1
(45) Date of Patent: Mar. 26, 2013

(54) TOOL FOR RENOTCHING TROWELS

(76) Inventor: Darrell W. Ellison, Derby, KS (US)

( * ) Notice: Subject to any disclaimer, the term of this patent is extended or adjusted under 35 U.S.C. 154(b) by 373 days.

(21) Appl. No.: 12/822,305

(22) Filed: Jun. 24, 2010

(51) Int. Cl.
*B24B 23/00* (2006.01)

(52) U.S. Cl. ..... 451/344; 451/349; 451/359

(58) Field of Classification Search ..... 451/344, 451/349, 359
See application file for complete search history.

(56) References Cited

U.S. PATENT DOCUMENTS 2,715,797 A * 8/1955 Fuller ..... 451/122
2,871,729 A 2/1959 Schoonover
5,479,675 A 1/1996 Pytlewski
5,503,046 A * 4/1996 Emter ..... 76/77
5,839,152 A 11/1998 Kruskamp
5,885,035 A 3/1999 Hoffschneider
6,238,448 B1 5/2001 Rouse et al.
6,631,658 B2 * 10/2003 Brown ..... 76/37
7,114,413 B1 * 10/2006 Behan ..... 76/89

* cited by examiner

*Primary Examiner* — Joseph J Hail
*Assistant Examiner* — Shantese McDonald
(74) *Attorney, Agent, or Firm* — Molly D. McKay

(57) ABSTRACT

The present invention is a tool for renotching a worn trowel. The invention consists of a grinding wheel adjustably mounted on an adjustable plate. The edge of the plate is provided with adjustable fingers for engaging the notches of a trowel to insure consistent spacing and depth of notches being formed in the trowel when grinding with the tool. The grinding wheel is attachable to an electric drill or similar motive device for rotating the wheel to thereby accomplish the grinding needed to renotch the worn trowel. The tool is provided with a handle for gripping the tool.

8 Claims, 2 Drawing Sheets

TOOL FOR RENOTCHING TROWELS

BACKGROUND OF THE INVENTION

1. Field of the Invention

The present invention relates to a tool that can be used in the field to renotch trowels that become worn. More specifically, the present invention is a grinding wheel mounted on an adjustable plate. The plate is provided with adjustable fingers for engaging the notches of a trowel to insure a consistent depth of grinding with the tool. The grinding wheel is attachable to an electric drill or similar motive device for rotating the wheel.

2. Description of the Related Art

Certain tradesmen, such as those who lay tile, will wear out a notched trowel fairly quickly due to abrasion on the edge of the trowel. Currently, to renotch trowels that have become worn, the grinding is done manually. This is a time consuming job and the renotching of the trowel results in notches that are non-uniform in depth and configuration. The present invention addresses this problem by providing a tool that can be used in the field and allows quicker and more consistent depths and spacing of notches when renotching a worn trowel.

SUMMARY OF THE INVENTION

The present invention is a tool for renotching a worn trowel. The invention consists of a grinding wheel adjustably mounted on an adjustable plate. The edge of plate is provided with adjustable fingers for engaging the notches of a trowel to insure consistent spacing and depth of notches being formed in the trowel when grinding with the tool. The grinding wheel is attachable to an electric drill or similar motive device for rotating the wheel to thereby accomplish the grinding needed to renotch the worn trowel.

DETAILED DESCRIPTION OF THE PREFERRED EMBODIMENT

Figure 3:
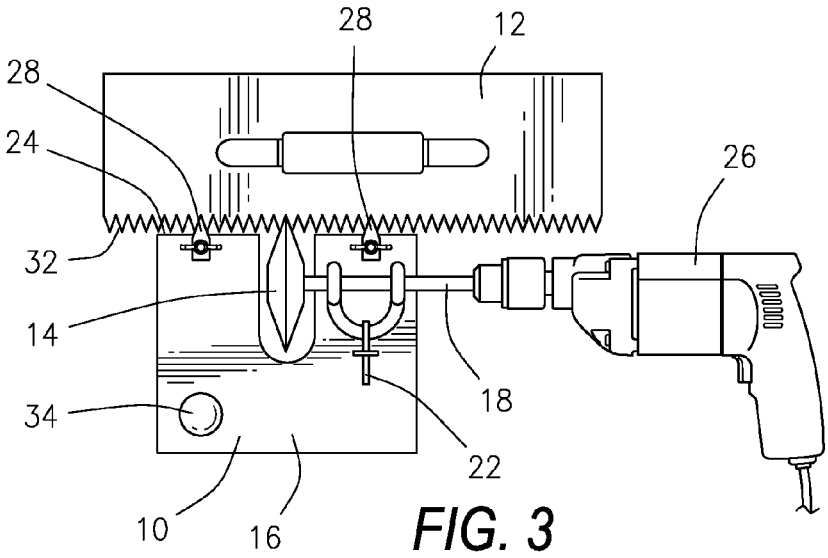
FIG. 3 is a top plan view of the tool of FIG. 1 shown attached to a drill and being used to renotch a worn trowel.
Figure 2:
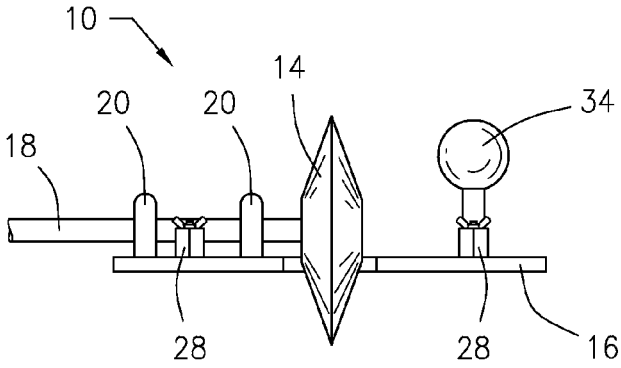
FIG. 2 is front view of the tool of FIG. 1.
Figure 1:
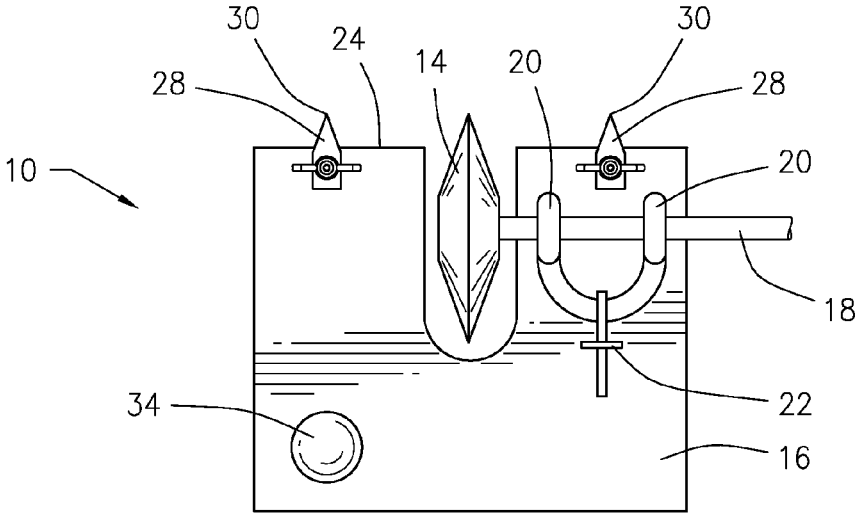
FIG. 1 is top plan view of a tool for renotching trowels constructed in accordance with a preferred embodiment of the present invention.

Referring now to the drawings and initially to FIGS. 1 and 2, there is shown a tool 10 for renotching a worn trowel 12. The tool 10 consists of a grinding wheel 14 adjustably mounted on a mounting plate 16. The grinding wheel 14 is provided with a shaft 18 that is rotatably held in place on the plate 16 by a pair of bearings 20. The bearings 20 are attached to the plate 16 by adjustment means 22 that allow the relative position of the grinding wheel 14 to be adjusted relative to a front edge 24 of the plate 16. Referring also to FIG. 3, the shaft 18 attaches to a drill 26 or other motive means for rotating the grinding wheel 14.

Figure 5:
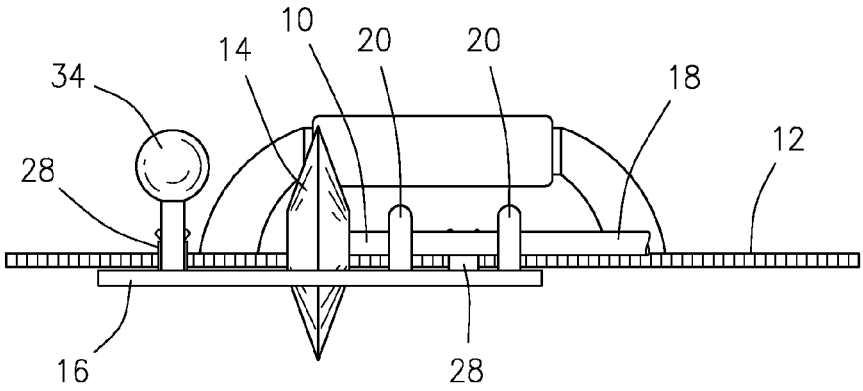
FIG. 5 is a front view of the tool and trowel of FIG. 4.
Figure 4:
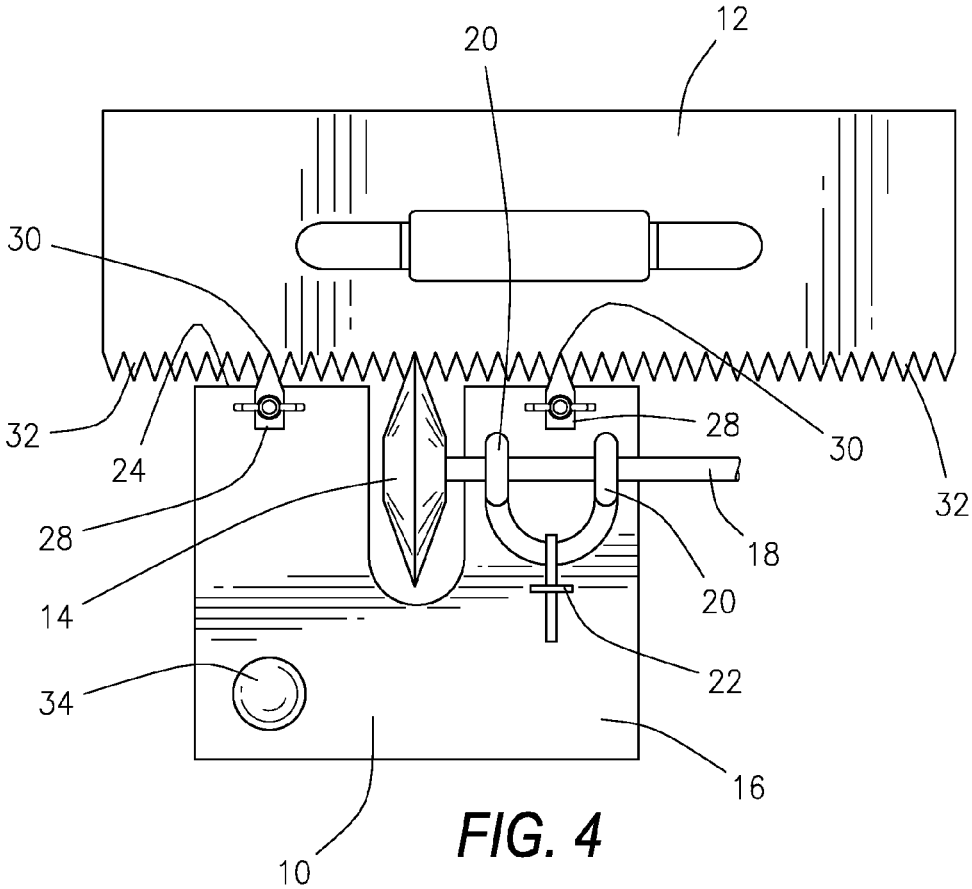
FIG. 4 is an enlarged view of the tool and trowel of FIG. 3.

As illustrated in FIGS. 3, 4 and 5, at least two fingers 28 are adjustably secured to the plate 16 so that a tip 30 of each finger 28 extends beyond the front edge 24 of the tool 10. The tips 30 of the fingers 28 engage the notches of the trowel 12 when the trowel 12 is placed at the front edge 24 of the plate 16 as it is being renotched by the rotating grinding wheel 14. The fingers 28 are adjustable in a parallel orientation to the front edge 24 of the plate 16 so that they can be adjusted to properly engage the notches 32 of the trowel 12. Proper engagement of the fingers 28 with the notches 32 of the trowel 12 insure consistent spacing and proper depth of notches 32 being formed in the trowel 12 by the grinding wheel 14. The position of the grinding wheel 14 relative to the front edge 24 of the plate 16 is adjustable by the adjustment means 22 to achieve the desired depth of notches 32 needed when renotching the worn trowel 12.

As illustrated in FIGS. 1-5, the tool 10 is preferably provided with a handle 34 for gripping the tool 10.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A tool for renotching a trowel comprising:

a v-shaped grinding wheel having two cutting sides that grind simultaneously to create a symmetrical v-shaped notch in a trowel;

said grinding wheel rotatably mounted on a hand-held mounting plate such that a longitudinal axis of the grinding wheel is oriented approximately parallel to a front edge of the mounting plate, means for aligning an edge of a trowel relative to a front edge of the mounting plate so that the grinding wheel engages and grinds notches into the edge of the trowel as the trowel is advanced toward the tool-mounted grinding wheel, and means for rotating the grinding wheel so that the wheel grinds notches into the edge of the trowel as the trowel advances toward the rotating grinding wheel.

2. A tool for renotching a trowel according to claim 1 wherein the grinding wheel is adjustably mounted on the mounting plate and is adjustable in position relative to the front edge of the mounting plate in order to achieve a desired depth of notches in the trowel.

3. A tool for renotching a trowel according to claim 1 wherein the means for aligning a trowel relative to a front edge of the mounting plate further comprises:

at least two fingers secured to the mounting plate so that a tip of each finger extends beyond the front edge of the mounting plate for engagement with notches of the trowel to insure consistent spacing of notches in the trowel.

4. A tool for renotching a trowel according to claim 3 wherein each finger is adjustably secured to the mounting plate.

5. A tool for renotching a trowel according to claim 4 wherein each finger is adjustable in a parallel orientation to the front edge of the mounting plate as a means of adjusting the spacing of notches to be cut into a trowel.

6. A tool for renotching a trowel according to claim 1 wherein the means for rotating the grinding wheel further comprises:

a shaft provided on the grinding wheel, said shaft attached to a rotary tool for rotating the shaft and the attached grinding wheel.

7. A tool for renotching a trowel according to claim 6 wherein the rotary tool is a drill.

8. A tool for renotching a trowel according to claim 1 further comprising:

a handle provided on the mounting plate for gripping the hand-held mounting plate and attached grinding wheel.

* * * * *